US008726783B2

(12) United States Patent
Berkovich et al.

(10) Patent No.: US 8,726,783 B2
(45) Date of Patent: May 20, 2014

(54) TURRET ASSEMBLY

(75) Inventors: Eyal Berkovich, Kiryat Tivon (IL); Shimon Chachamian, Haifa (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 13/884,213

(22) PCT Filed: Nov. 3, 2011

(86) PCT No.: PCT/IL2011/000860

§ 371 (c)(1),
(2), (4) Date: May 8, 2013

(87) PCT Pub. No.: WO2012/063235

PCT Pub. Date: May 18, 2012

(65) Prior Publication Data

US 2013/0220109 A1 Aug. 29, 2013

(30) Foreign Application Priority Data

Nov. 8, 2010 (IL) ..... 209195

(51) Int. Cl.

| | |
|---|---|
| ***F41H 5/20*** | (2006.01) |
| ***F41A 23/24*** | (2006.01) |
| ***F41A 27/20*** | (2006.01) |
| ***F41H 7/02*** | (2006.01) |
| *F41H 5/22* | (2006.01) |

(52) U.S. Cl.

CPC ..... *F41A 23/24* (2013.01); *F41A 27/20* (2013.01); *F41H 5/20* (2013.01); *F41H 7/02* (2013.01); *F41H 5/223* (2013.01)

USPC ..... 89/36.13

(58) Field of Classification Search

CPC ..... F41A 23/24; F41A 27/20; F41H 5/20; F41H 5/223; F41H 7/02; F41H 7/00

USPC ..... 89/36.13

See application file for complete search history.

(56) References Cited

U.S. PATENT DOCUMENTS 1,351,383 A * 8/1920 Hitt ..... 89/38
2,016,292 A * 10/1935 Rarey ..... 89/36.13
2,175,852 A * 10/1939 Perkins ..... 89/36.13

(Continued)

FOREIGN PATENT DOCUMENTS

WO WO-2005/118295 A2 12/2005

OTHER PUBLICATIONS

International Preliminary Report on Patentability issued in PCT/IL/11/00860 (dated Feb. 28, 2013).

*Primary Examiner* — Samir Abdosh

(74) *Attorney, Agent, or Firm* — Venable LLP; Robert Kinberg

(57) ABSTRACT

A turret assembly without deck penetration for minimizing exposure of combatants to enemy forces when accessing above deck equipment comprises a base plate on top of which is mounted at least one finable and remotely operable combatant interfaceable implement, the base plate being rotatable about a substantially vertical axis and supported for rotation by bearing means mounted within a deck of a military facility; a hatch displaceably connected to the base plate, for normally covering a hatchway formed in said base plate and for exposing said hatchway when displaced; and a rotatable disc of a slip ring unit carried by the hatch, by which electricity for operating equipment mounted on top of the deck and for initiating control signals is transmitted to the equipment.

20 Claims, 13 Drawing Sheets

(56) References Cited

U.S. PATENT DOCUMENTS

| | | | | | |
|---|---|---|---|---|---|
| 3,954,041 | A | | 5/1976 | Mechulam et al. | |
| 5,220,127 | A | * | 6/1993 | Tiomkin et al. | 89/36.14 |
| 5,353,680 | A | * | 10/1994 | Tiomkin et al. | 89/37.03 |
| 5,949,015 | A | | 9/1999 | Smith et al. | |
| 6,285,934 | B1 | | 9/2001 | Shaw | |
| 6,769,347 | B1 | | 8/2004 | Quinn | |
| 6,886,447 | B2 | | 5/2005 | Crotty et al. | |
| 7,293,493 | B2 | | 11/2007 | Persson et al. | |

* cited by examiner

TURRET ASSEMBLY

FIELD OF THE INVENTION

The present invention relates to the field of Remote Controlled Weapon Systems or Stations (hereinafter RCWS). More particularly, the present invention relates to a turret assembly for use in conjunction with a RCWS.

BACKGROUND OF THE INVENTION

A RCWS is used for light and medium caliber weapons and can be installed on any type of land and sea-based vehicle. Modern military vehicles are provided with such equipment, which allow a gunner to remain in the relative protection of the vehicle. The RCWS may be installed when the vehicle is being manufactured or may be retrofitted on an existing vehicle.

A typical RCWS enables a variety of devices to be operated automatically or by remote control, including 5.56 mm, 7.62 mm, and 12.7 mm machine guns, as well as 40 mm automatic grenade launchers, 30 mm cannons, anti-tank missiles, and even observation pods. Such an RCWS is designed to be mounted on, for example, light-armored, high-mobility military vehicles and an upper surface of stationary posts, and is adapted to be operated by a gunner or vehicle commander operating under-the-deck.

Other information concerning a RCWS can be obtaining by referring for example to U.S. Pat. No. 5,949,015, U.S. Pat. No. 6,769,347, U.S. Pat. No. 7,293,493, and WO 2005/118295.

A typical RCWS is mounted with one or more barrel weapons, each of which is fed with ammunition by means of an ammunition belt consisting of a long string of cartridges fastened together and of a suitable feed mechanism, or is provided with a linkless ammunition loading system.

The orientation of a barrel is generally adjusted, for example in order to aim at a selected target, by rotating a turret assembly on top of which the RCWS is mounted. As the RCWS is of a limited volume and the turret assembly can support equipment only of a limited weight, including the RCWS, control equipment, communication equipment, and the ammunition, the amount of ammunition that can be stored in the RCWS is consequently also limited. The ammunition therefore has to be frequently replenished.

In order to access above deck equipment, such as to replenish the stock of ammunition, the combatant is endangered and dangerously exposed, for example to enemy forces, outside the confines of the vehicle and during an extended period of time.

Some weapon systems are equipped with a mechanical mechanism for the remote loading of ammunition. An enclosure in which are installed remote ammunition loading mechanisms downwardly extending from deck of the carrier vehicle into its interior, normally referred to as a "turret basket, is often used. As the ammunition quantity decreases, it is feasible to replenish the ammunition stock inside the turret basket while being located within a relatively sheltered space.

Naturally, mechanical mechanisms for the remote feeding of weapon systems are relatively cumbersome. As a consequence of the complexity of these ammunition feeding systems, the probability for the occurrence of malfunctions in their operation is increased.

The existence of such mechanical mechanisms for the remote feeding of weapon systems also mandates the necessity to allocate an otherwise free volume inside the inner space of the carrier vehicle in order to accommodate the turret basket. A substantial usable volume of the combatants' compartment would have to be reduced, even though this volume is already small and congested. It is also to be remembered that the presence of active mechanisms for advancing the belts of rounds or for rotating the turret basket presents a threat and safety danger to the combatants staying in the crammed compartment in the immediate proximity of the turret basket.

It is an object of the present invention to provide apparatus for accessing above deck equipment without excessive exposure of the combatants to enemy forces, without allocating free space within the RCWS, and without reducing the available usable volume within the combatant compartment located within the inner space of the carrier vehicle.

It is an additional object of the present invention to provide apparatus for accessing above deck equipment which is relatively low priced and simple to manufacture, install and operate, and which will generally not be subject to malfunctions.

Other objects and advantages of the invention will become apparent as the description proceeds.

SUMMARY OF THE INVENTION

The present invention provides a turret assembly without deck penetration for minimizing exposure of combatants to enemy forces when accessing above deck equipment, comprising a base plate on top of which is mounted at least one firable and remotely operable combatant interfaceable implement, said base plate being rotatable about a substantially vertical axis and supported for rotation by bearing means mounted within a deck of a military facility; a hatch displaceably connected to said base plate, for normally covering a hatchway formed in said base plate and for exposing said hatchway when displaced; and a rotatable disc of a slip ring unit carried by said hatch, by which electricity for operating equipment mounted on top of said deck and for initiating control signals is transmitted to said equipment.

The hatchway is sufficiently large to accommodate the passage therethrough to the deck of a combatant usable product, e.g. ammunition, in order to access the above deck equipment when the hatch is in a completely displaced position.

When the above deck equipment is accessed, above deck activities which include, but are not limited to, replenishing the stock of ammunition, loading ammunition, gun stoppage related operations, direct aiming of a weapon station, and manual firing operations, are performable.

The base plate of the turret assembly may be rotatably mounted within the deck of an armored vehicle, such as one selected from the group consisting of a tank, a retriever, a light armored vehicle, a mobile missile launcher, an armored personnel carrier, and a waterborne combat vehicle, or within the deck of a stationary military facility, such as a defense post, including but not limited to an infantry post and a border police post.

In one embodiment, the hatch is pivotally connected to the base plate.

In one embodiment, the hatch is displaceably connected to the base plate by means of four arm assemblies which allow the hatch to be lowered and displaced laterally from the base plate and then to be returnably displaceable so as to cover the hatchway.

In one embodiment, the hatch is displaceably connected to the base plate by means of a rod extending downwardly from the base plate and an engagement member that is attached to the inner face of the hatch and is rotatably mounted about said rod, allowing the hatch to be rotatable about said rod.

In one aspect, the turret assembly further comprises latch means securable to a stationary disc of the slip ring unit to prevent displacement of the hatch.

In one aspect, the latch means comprises a retractable element that is sufficiently spaced from a corresponding side edge of the hatch when retracted to enable unobstructed displacement of the hatch.

In one aspect, the turret assembly further comprises a hatch displacement initiator.

In one aspect, the hatch displacement initiator comprises a handle connected to an interior facing end of an axle assembly rotatably mounted within the hatch for applying a displacement initiating force to the hatch, and a locking bar, e.g. a flexible locking bar, connected to an exterior facing end of the axle assembly and having substantially the same angular disposition as the handle, rotation of the handle in a first rotational direction causing the locking bar to be positioned in abutting relation with an upper surface of the base plate whereby to prevent the hatch from opening, and subsequent rotation of the handle in a second rotational direction opposite to said first rotational direction causing said locking bar to be disengaged from the base plate.

In one aspect, the hatch displacement initiator comprises one or more linear actuators connected to an above deck surface fixedly attached to the base plate. The one or more linear actuators is selected from the group consisting of a hydraulic actuator, pneumatic actuator, and electric actuator.

In one aspect, the combatant interfaceable implement is a weapon system.

In one aspect, the slip ring unit comprises an input port unit for connection from an electrical source and an output port unit for connection with the equipment.

In one aspect, the turret assembly further comprises control means for preventing the base plate from rotating when the hatch is opened.

In one aspect, the control means comprises a sensor for detecting an openable state of the hatch, and a controller for receiving signals from said sensor and for commanding a turret motor adapted to rotationally drive the base plate to become deactivated when receiving a signal from said sensor that the hatch has been set to an openable state.

In one aspect, the hatch is set to an openable state when it is in a displaced position.

In one aspect, the hatch is set to an openable state when a handle rotatably mounted within the hatch for applying a displacement initiating force has been rotated.

DETAILED DESCRIPTION OF PREFERRED EMBODIMENTS

The present invention is a novel turret assembly that is provided with a displaceable hatch, on which is carried a slip ring unit. A bodily portion of a combatant is therefore able to pass through the hatchway when having to access the weapon station mounted on top of the turret assembly, obviating the need of exiting the combat vehicle in order to climb on top of the combat vehicle deck while being exposed to enemy forces.

Figure 1:
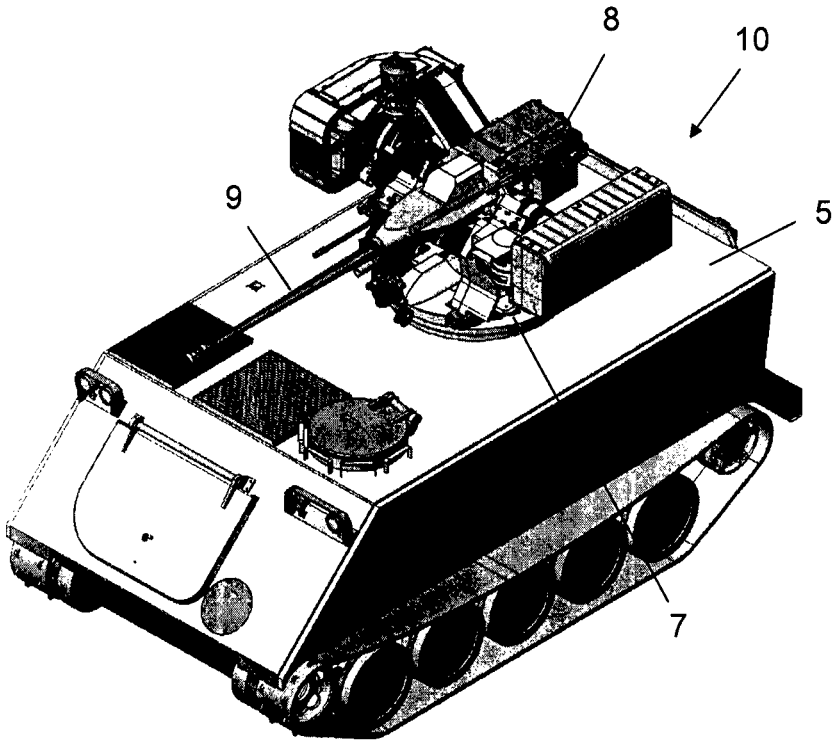
FIG. 1 is a perspective view of an exemplary turreted armored combat vehicle.

An exemplary armored combat vehicle 10 is illustrated in FIG. 1. In a central portion of deck 5 is rotatably mounted a turret assembly 7. A weapon station 8, generally comprising at least one machine gun 9, such as an anti-tank gun or an anti-aircraft gun, is mounted on turret assembly 7, and can be aimed and fired at a desired target by rotating the turret assembly, as controlled remotely by a gunner or vehicle commander located within the confines of vehicle 10 and under deck 5. Other types of equipment that may also be mounted to turret assembly 7 include a smoke grenade launcher, a laser warning system, an electronic control unit, and communication equipment. Combat vehicles that may be provided with the turret assembly of the present invention included tanks, retrievers, light armored vehicles, mobile missile launchers, and armored personnel carriers, or any waterborne combat vehicle.

Figure 2:
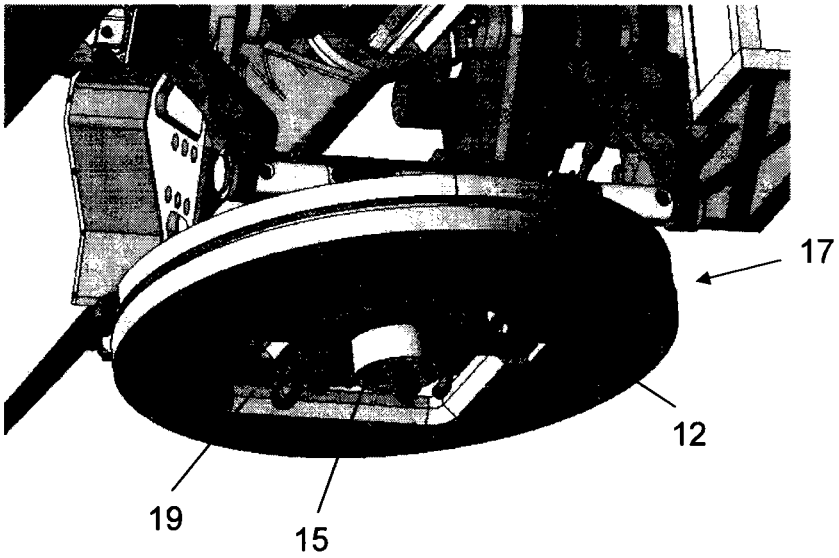
Fig. 2 (Prior Art)
FIG. 2 is a perspective view from the bottom of a prior art turret assembly, showing that passage through the base plate to the combat vehicle deck is obstructed.

In order to appreciate the utility of the present invention, reference is first made to FIG. 2, which illustrates a turret assembly 17 of the prior art, to which is operatively connected a pancake shaped slip ring unit 15. Slip ring unit 15, by which electricity for operating equipment and for passing control signals is transmitted to the equipment mounted on top of turret assembly 17, is positioned within a recessed portion 19 formed within a central region of the underside of rotatable base plate 12. Slip ring unit 15 comprises a rotating part connected to base plate 12, a stationary part, and brushes arranged on the rotating part. Electricity is delivered from a stationary source within the vehicle, and is transmitted by means of the brushes to a port located on top of base plate 12. Electricity delivered to the port is distributed to the various types of equipment located on top of the deck. Coolant and hydraulic fluid is also deliverable by means of a fluid rotary joint, possibly interfacing with the slip ring with use of a plurality of suitable seals, to the above-deck equipment through base plate 12.

As the rotating part of slip ring unit 15 is permanently connected to base plate 12, passage through the base plate to the vehicle deck is prevented so that the above-deck equipment can be accessed, in order to reload the ammunition, to correct feeding malfunctions, and for maintenance purposes. That is, even if a through-bore opening were formed within base plate 12, such an opening would be considerably smaller than the dimensions of a combatant usable product, e.g. 0.25 $m^2$, due to the presence of slip ring 15 and the fluid rotary joint. Typical combatant usable products that are needed in order to access the above-deck equipment include tools, a toolbox, diagnostic equipment, and an ammunition box. Since the above-deck equipment is inaccessible from within the combatant compartment, the combatant is forced to exit the combat vehicle and then climb onto the deck.

Figure 3:
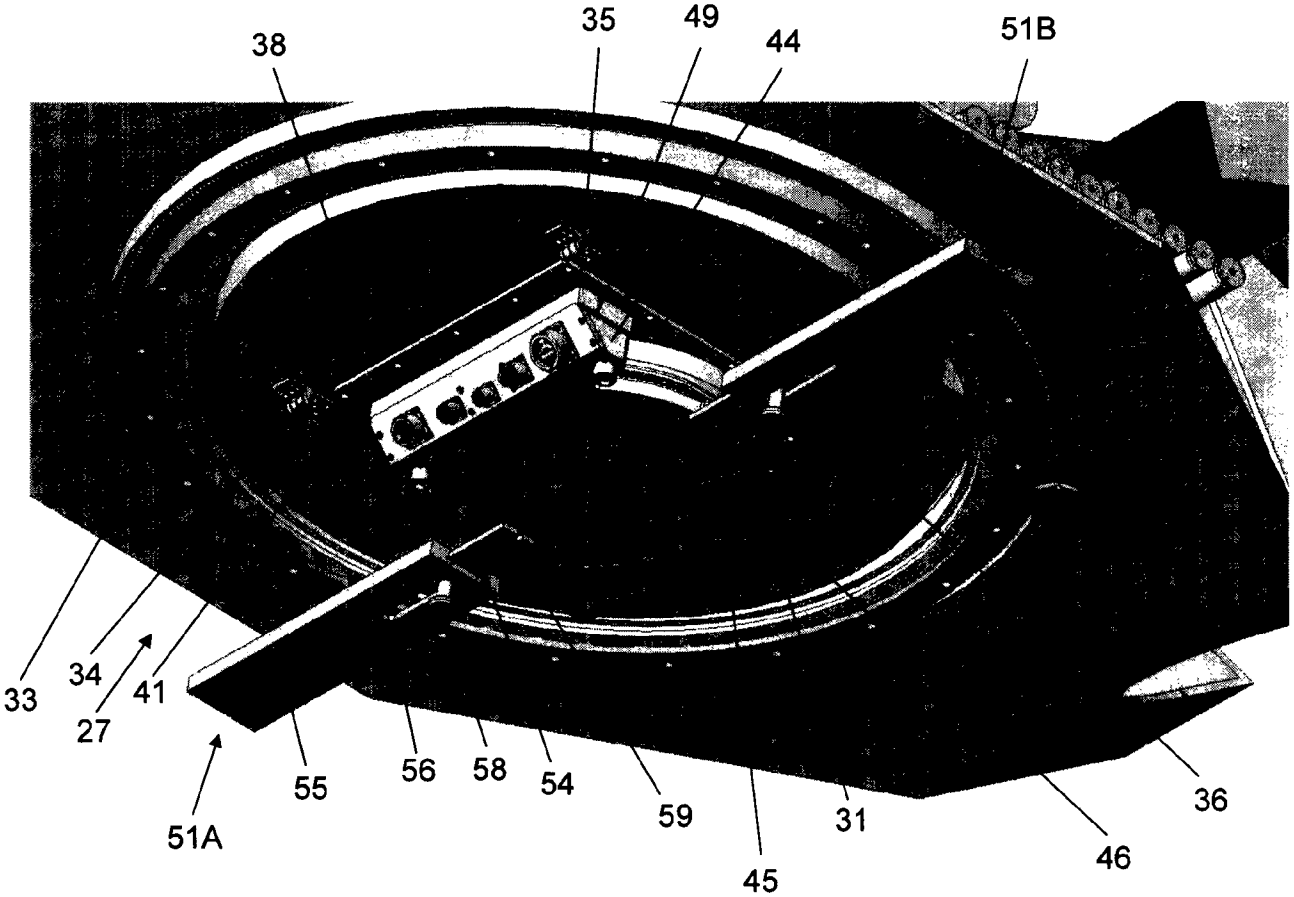
FIG. 3 is a perspective view from the bottom of a turret assembly according to one embodiment of the present invention, showing a stationary element of a slip ring unit being secured by latches.

FIG. 3 illustrates a turret assembly 27 according to one embodiment of the present invention. Turret assembly 27 comprises base plate 31 and turret bearing 33, about which base plate 31 is rotatable a complete rotation or a fraction thereof with respect to a vertical axis. A hatchway is formed in base plate 31 to allow passage of a combatant usable product from the interior of the combat vehicle to the upper surface of the deck, and is covered by an openable and closable planar hatch 36. Two hinges 34 and 35 pivotally attach end 38 of hatch 36 to base plate 31.

Mounting plate 41 connected to the rotatable disc of slip ring unit 45 is attached to hatch 36, to permit rotation when base plate 31 is rotated. Protruding through mounting plate 41 is base 49 of an output port unit for connection to the above-deck equipment. Output port unit base 49 is shown to be aligned with input port unit 44, which is connected to stationary disc 46 of ring unit 45 and comprises a plurality of ports facing the combatant compartment for electrical connection, signal command connection, hydraulic connection, or pneumatic connection from a corresponding source disposed within the interior of the combat vehicle. When base plate 31 is rotated, the output port unit is displaced together with mounting plate 41, being separated from the stationary input port unit 44.

Two laterally separated latches 51A and 51B are used for securing stationary disc 46, to prevent hatch 36 from being pivoted during normal operation of turret assembly 27 and of the equipment mounted thereto. Each of latches 51A and 51B comprises a stationary holder 55 formed with an elongated opening 56, e.g. elliptical as shown, a bar 54 received in a channel formed within, and displaceable with respect to, holder 55, and a handle 58 attached to bar 54 and protruding through opening 56. Bar 54 and holder 55 may be rectangular as shown, or may be of any other desired shape. Holder 55 may be attached or welded to the deck, or may be held stationary by any other means well known to those skilled in the art. Bar 54 may be configured with a groove 59, e.g. a semielliptical groove, which is adapted to be secured to stationary disc 46.

The equipment mounted on top of the base plate or on top of the deck may be operated remotely when hatch 36 is in a closed position.

Figure 4:
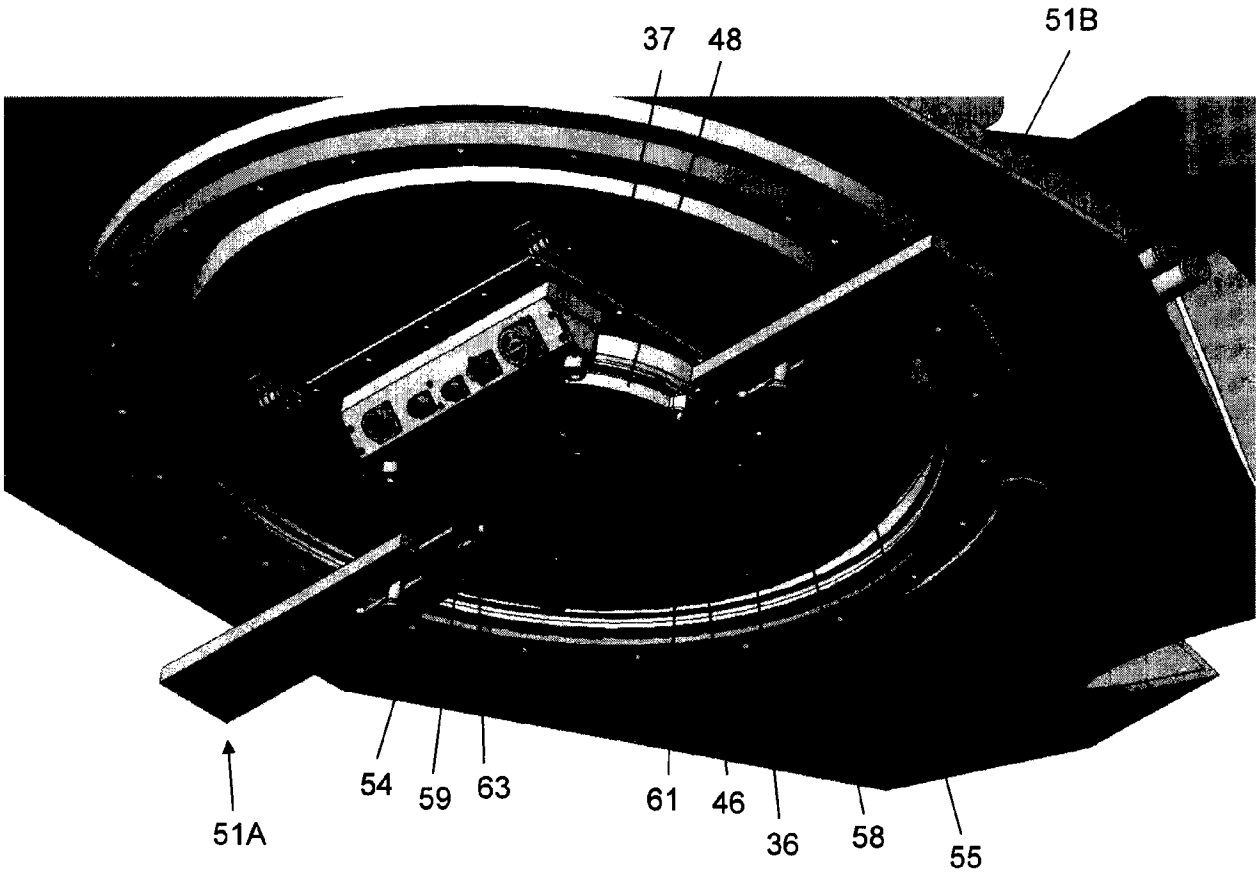
FIG. 4 is a perspective view from the bottom of the turret assembly of FIG. 3, showing the latches in a retracted position.
Figure 5:
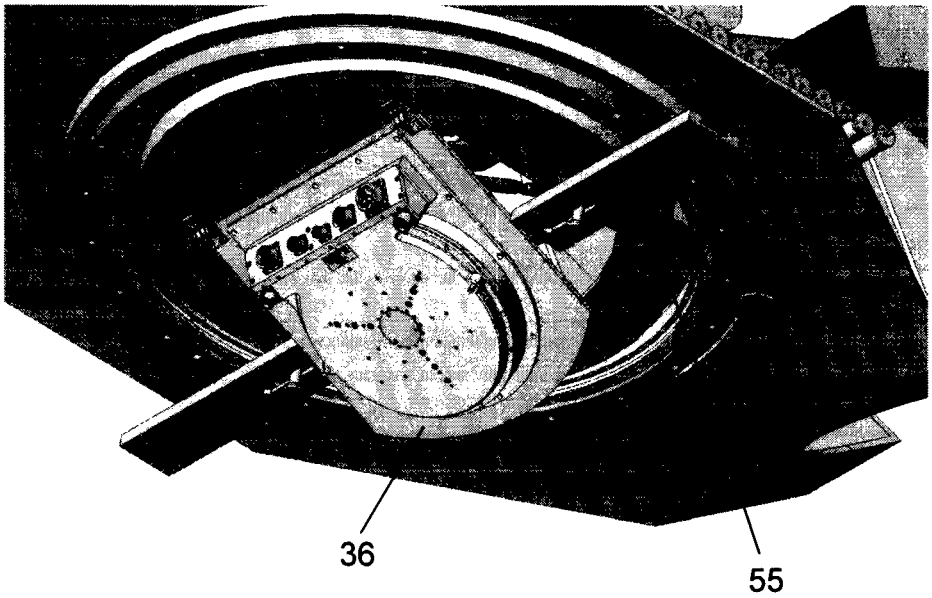
FIG. 5 is a perspective view from the bottom of the turret assembly of FIG. 3, showing a hatch in a pivoted position.

As shown in FIG. 4, stationary disc 46 is provided with two diametrically opposite catches 61. Each catch 46, which may be spring biased, may be attached to peripheral edge 48 of stationary disc 46, or alternatively, may be attached in any other suitable fashion to stationary disc 46. Groove 59 extending inwardly from ring-facing straight edge 63 of bar 54 is configured to receive, and be secured to, catch 61 when bar 54 is fully extended, as shown in FIG. 3. When handle 58 is laterally shifted, as shown in FIG. 4, groove 59 is separated from catch 61 and bar 54 is correspondingly displaced. Holder 55 is suitably positioned so that when bar 54 is fully retracted, the corresponding side edge 37 of hatch 36 is unobstructed, allowing hatch 36 to be pivoted inwardly into the vehicle interior, as shown in FIG. 5.

Figure 6:
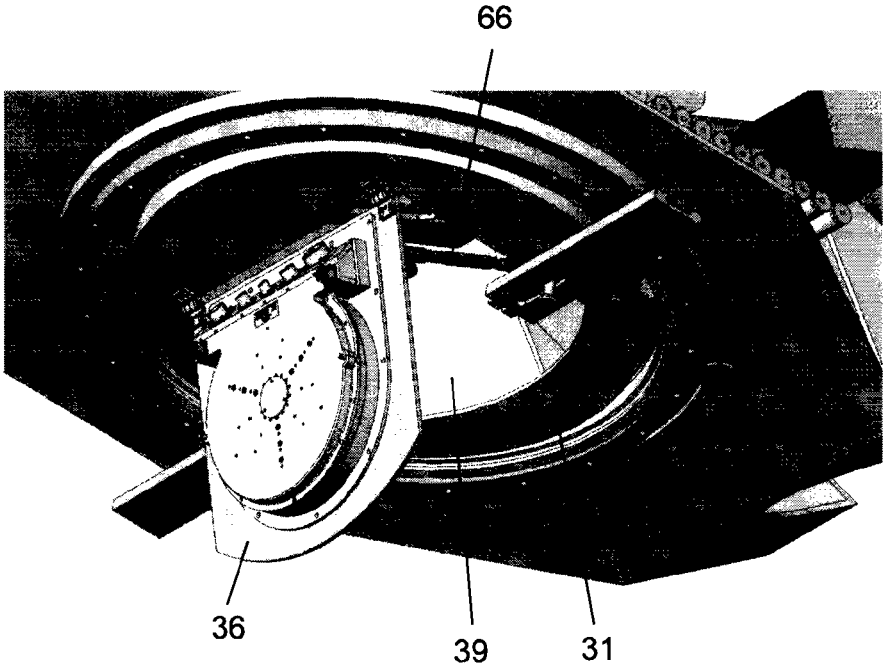
FIG. 6 is a perspective view from the bottom of the turret assembly of FIG. 3, showing a hatch in a completely pivoted position and an input port unit mounted thereon.

Hatch 36 is shown to be in a fully pivoted position in FIG. 6, exposing hatchway 39 which is centrally formed within base plate 31. Through-bore hatchway 39 is sufficiently large to accommodate the dimensions of a combatant usable product that is passed therethrough to the deck in order to perform certain above-deck functions such as reloading the ammunition, correcting feeding malfunctions, and maintenance operations (hereinafter "equipment accessing").

Hatch 36 may be pivotable by means of one or more linear actuators 66. Each linear actuator 66, which may be of the hydraulic, pneumatic, mechanical, or electric type, comprises a housing and an extendable rod e.g. telescopingly extendable, which is linearly extendable from the housing. The rod may be pivotally connected by means of a pin joint to hatch 36 and the housing may be pivotally connected by means of a pin joint to a surface fixedly attached to the base plate above the deck. As the rod is extended, a force is applied to hatch 36, causing the latter to change its inclination with respect to base plate 31. Both the rod and housing pivot about their pin joint while the inclination of hatch 36 continuously changes until achieving a completely open and substantially vertical position. A spring may be attached to hatch 36 in order to counterbalance its pivoting action without interfering with the extendible rod. The illustrated open position of hatch 36 corresponds to the maximum extension of the rod.

When the rod is retracted to its minimal extent, it may be locked in place by conventional means well known to those skilled in the art to prevent hatch 36 against unwanted opening during rotation of base plate 31, in addition to the force applied by latches 51A and 51B, as shown in FIG. 3.

Figure 7:
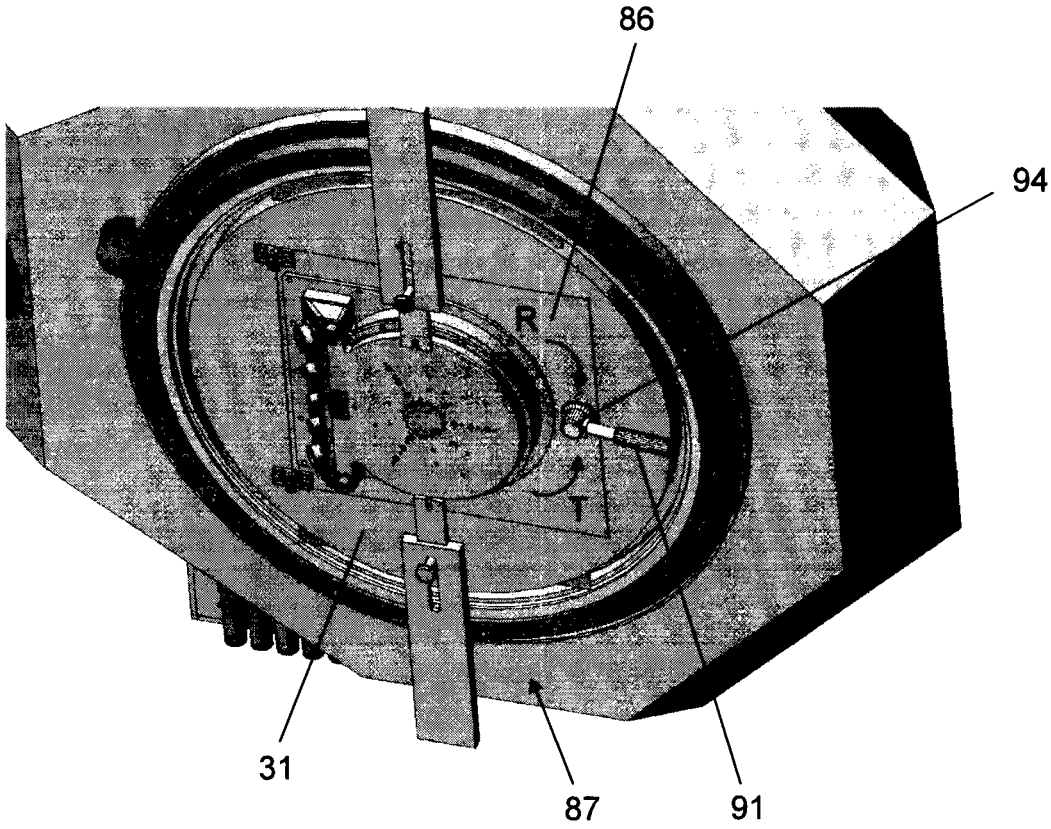
FIG. 7 is a perspective view from the bottom of a turret assembly according to another embodiment of the present invention, showing a stationary element of a slip ring unit being secured by latches.
Figure 8:
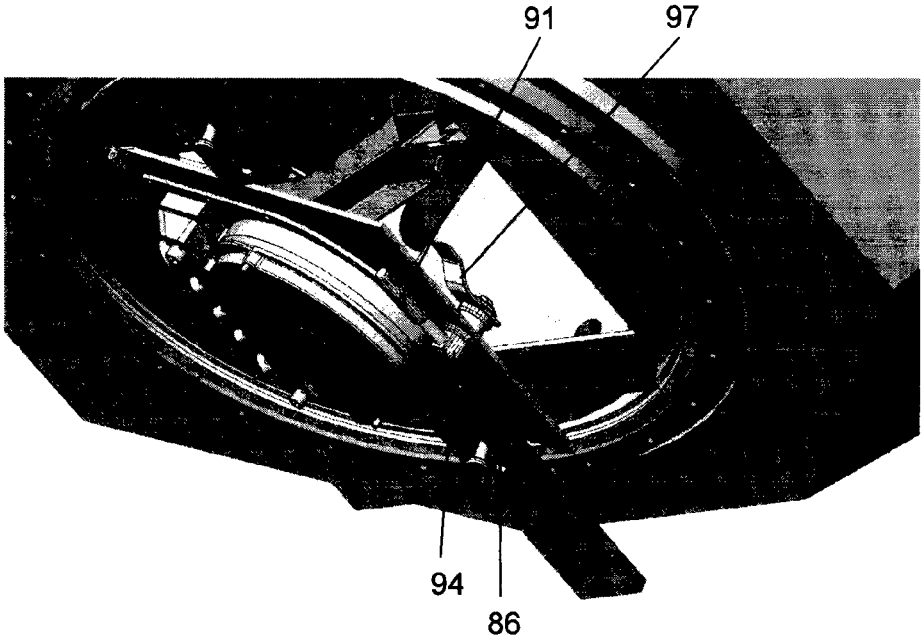
FIG. 8 is a perspective view from the bottom of the turret assembly of FIG. 7, showing a hatch in a pivoted position.

Alternatively, as shown in FIGS. 7 and 8, hatch 86 of a turret assembly 87 may be provided with a handle 91 for opening and closing hatch 86. Handle 91 may be connected to the interior facing end of an axle assembly 94 rotatably mounted within hatch 86. A locking bar 97 may be connected to the exterior facing end of axle assembly 94 and have substantially the same angular disposition as handle 91. Thus when hatch 86 is in a normal unpivoted position substantially flush with base plate 31 as shown in FIG. 7, rotation of handle 91 in direction R will place locking bar 97 in abutting relation with the upper surface of base plate 31 to prevent hatch 86 from opening. Subsequent rotation of handle 91 in direction T opposite to direction R will cause locking bar 97 to be disengaged from base plate 31 and to allow hatch 86 to be pivoted after applying a pulling force to the handle, as shown in FIG. 8. Locking bar 97 may be flexible, such as configured with camming surfaces as shown, to facilitate effortless engagement and disengagement with hatch 86.

Figure 9:
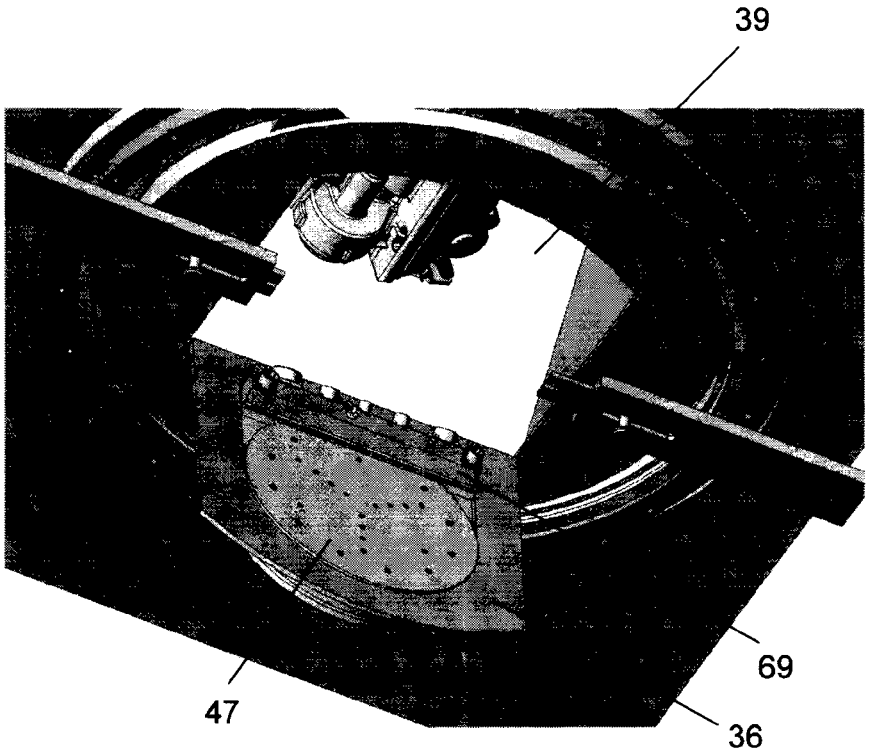
FIG. 9 is a perspective view from the side of the hatch of FIG. 6 when in a completely pivoted position, showing the inner face thereof and an output port unit mounted thereon.

FIG. 9 illustrates the inner face of hatch 36 when in a fully pivoted position. Rotatable disc 47 of the slip ring unit is shown, as well as output port unit 69. Output port unit 69 comprises a plurality of ports for electrical connection, signal command connection, hydraulic connection, or pneumatic connection to a corresponding type of equipment located on top of the combat vehicle. Output port unit 69 is in electrical communication with input port unit 49 (FIG. 3) by means of the brushes of the slip ring unit, which are in engagement with the conductors of the rotatable disc. Thus the transmission conducted through each cable connected to the input port unit will also be conducted through a corresponding cable connected to output port unit 69 and extending to an above-deck piece of equipment, regardless of the rotational disposition of output port unit 69. Both the stationary and rotatable discs of the slip ring unit are mounted within hatch 36, allowing a transmission to be continuously conducted from the input port unit to an above-deck piece of equipment via the output port unit even when hatch 36 is in a fully pivoted position. The cables connecting output port unit 69 and the equipment located on top of the deck are sufficiently long so that they will not be damaged when hatch 36 is in a fully pivoted position.

Figure 10:
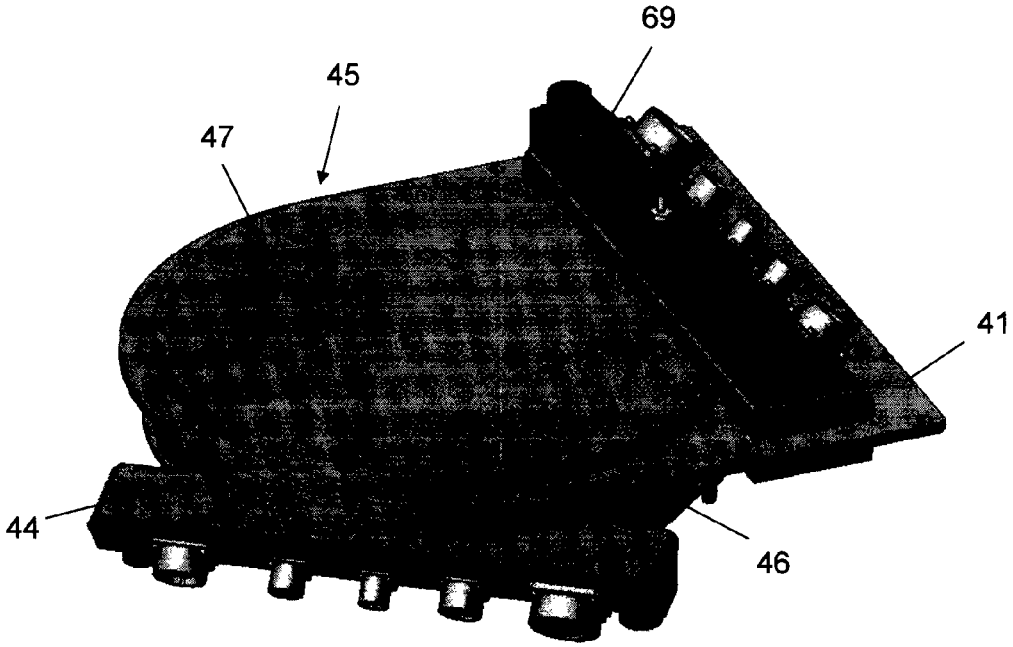
FIG. 10 is a perspective view from the top of a slip ring unit while the hatch is removed, showing the output port unit when angularly spaced from the input port unit.

FIG. 10 illustrates slip ring unit 45 after rotatable disc 47 has been rotated together with the base plate which is not shown and mounting plate 41 attached to the base plate. Output port unit 69 attached to mounting plate 41 is accordingly shown to be angularly spaced from input port unit 44 mounted on stationary disc 46.

Figure 11:
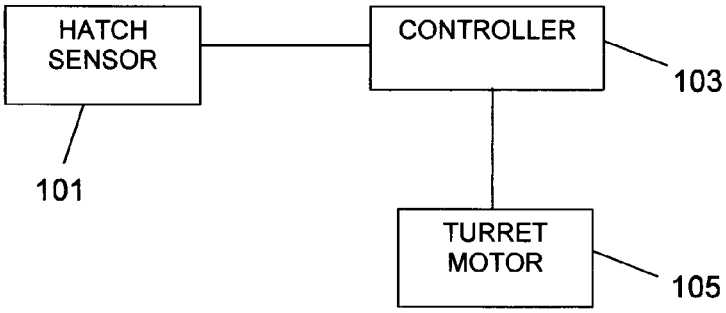
FIG. 11 is a block diagram of an automatic control for preventing the base plate from rotating when the hatch is opened.

FIG. 11 illustrates an automatic control for preventing the base plate from rotating when the hatch is opened. The hatch is provided with a sensor 101, such as an orientation sensor or a limit switch, for detecting whether the hatch is in an unpivoted or a pivoted position. Controller 103 receives signals from sensor 101, and commands turret motor 105 for rotationally driving the base plate to become deactivated when receiving a signal that the hatch has been opened. If a handle arrangement for pivoting the hatch is employed as shown in FIG. 8, controller 103 may command turret motor 105 to become deactivated when receiving a signal that the handle has been rotated. Thus damage to the turret assembly, above-deck equipment, and to the combatants located in the interior of the vehicle which would be caused by the pivoting of the hatch when the base plate is being rotated will be prevented.

Figure 12:
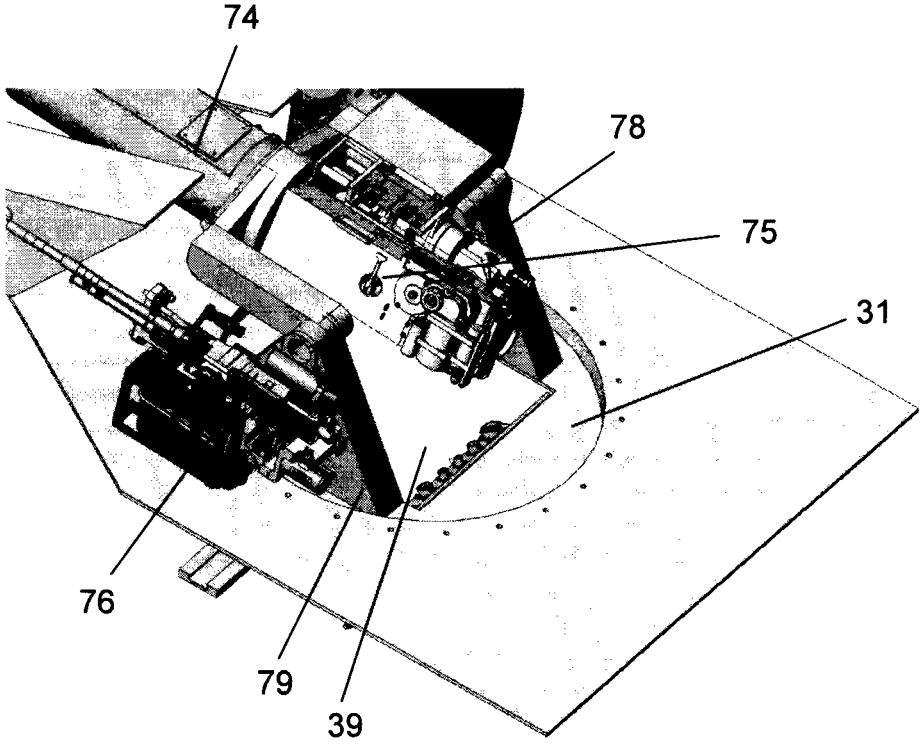
FIG. 12 is a top perspective view of the turret assembly of FIG. 3 when the hatch of FIG. 6 is in a completely pivoted position, showing a weapon system that can accessed via the hatchway.

FIG. 12 illustrates the accessibility of a weapon system with respect to a hatchway 39 when the hatch is opened. A main gun 74 and secondary gun 76 are shown to be mounted on top of base plate 31 by means of triangular mounts 78 and 79, respectively. Mounts 78 and 79 are positioned such that hatchway 39 is interposed therebetween. Firing assembly 75 of main gun 74 is positioned above hatchway 39, so that a combatant may advantageously remain within the vehicle interior when accessing main gun 74. Although secondary gun 76 cannot be accessed from the vehicle interior, the exposure of a combatant to enemy forces is held to a minimum when accessing secondary gun 76 since the latter is positioned adjacent to hatchway 39 and therefore the combatant needs to be above deck for no more than a few minutes. A protective shield surrounding mounts 78 and 79 may be provided to protect a combatant passing through hatchway 39. The arrangement of the equipment mounted to base plate 31 may be different than that the equipment arrangement mounted to a prior art turret assembly due to the presence of hatchway 39.

Figure 13:
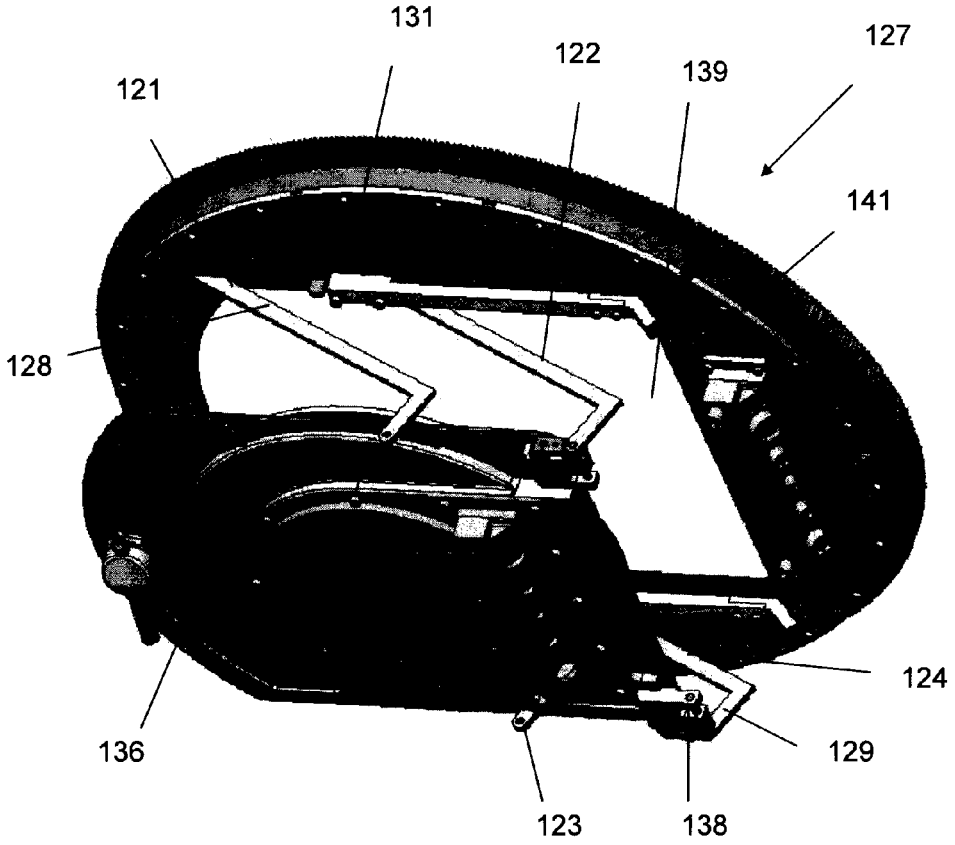
FIG. 13 is a perspective view from the bottom of a turret assembly according to another embodiment of the present invention, shown in an opened position.

FIG. 13 illustrates a turret assembly 127 according to another embodiment of the invention. In this embodiment, hatch 136 is displaceably connected to base plate 131 by means of four arm assemblies 121-124, each of which comprising two links 128 and 129 that are pivotally connected to each other and to another element. Link 128 of arm assemblies 121-124 is pivotally connected to base plate 131. Link 129 of arm assemblies 121 and 123 is pivotally connected to hatch 136, while link 129 of arm assemblies 122 and 124 is pivotally connected to a corresponding latch holder 138, which is attached to the inner face of hatch 136. As a result of this configuration, hatch 136 is able to be lowered from base plate 131 and then be displaced laterally from hatchway 139, for example laterally from the base plate, when set to an opened state, to enable unobstructed passage through the hatchway. When hatch 136 is completely closed, the latch of each latch holder 138, which may be e.g. spring biased or manually adjusted, is engaged with a corresponding catch 141 attached to the inner face of base plate 131.

Figure 14:
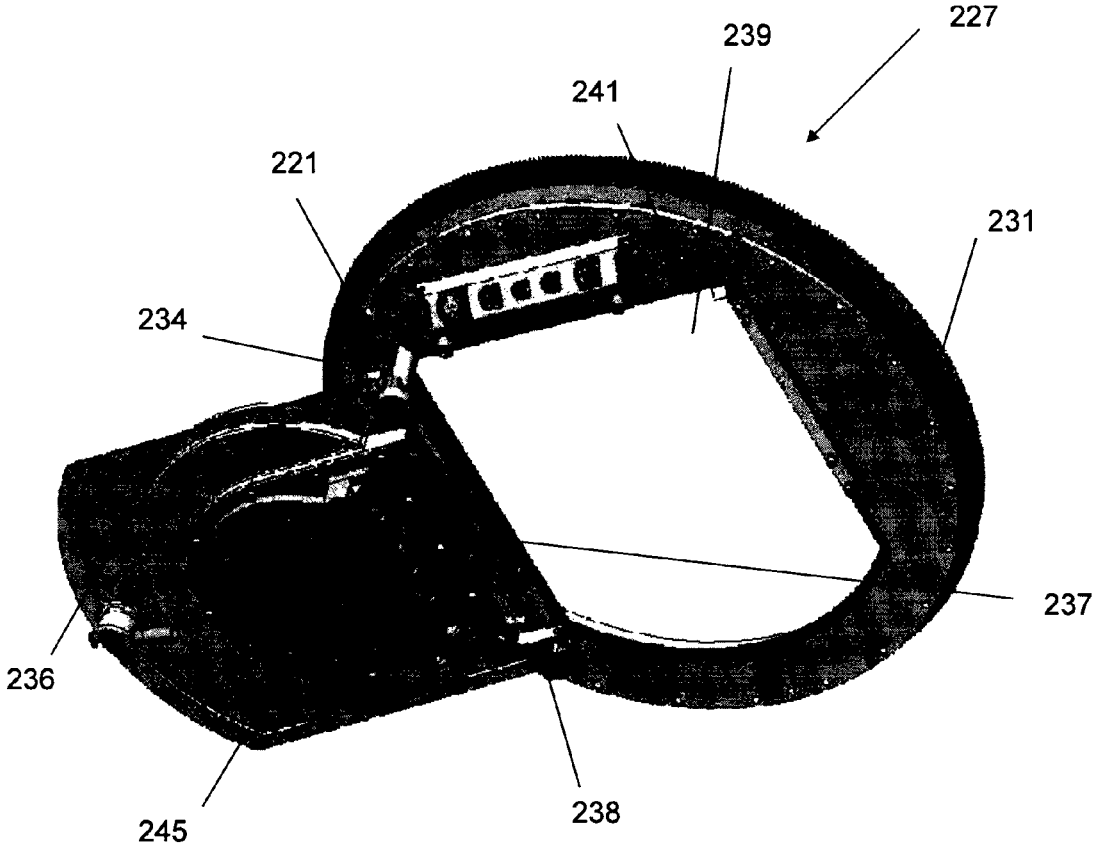
FIG. 14 is a perspective view from the bottom of a turret assembly according to another embodiment of the present invention, shown in an opened position.

FIG. 14 illustrates a turret assembly 227 according to another embodiment of the invention. In this embodiment, hatch 236 carrying slip ring unit 245 is displaceably connected to base plate 231 by means of a rod 221 extending downwardly from base plate 231 and an engagement member 234 that is attached to the inner face of hatch 236 and is rotatably mounted about rod 221. As a result of this configuration, hatch 236 is able to be rotated about rod 221 to an opened position, as illustrated, to enable unobstructed passage through hatchway 239. When hatch 236 is rotated in an opposite direction to become completely closed, the latch of latch holder 238, which is attached to hatch 236 and protrudes from hatch edge 237, is engaged with a corresponding catch 241 attached to the inner face of base plate 231. Engagement member 234 and latch holder 238 are attached to hatch 236 at opposite ends of hatch edge 237.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A turret assembly without deck penetration for minimizing exposure of combatants to enemy forces when accessing above deck equipment, comprising:

a) a base plate on top of which is mounted at least one firable and remotely operable combatant interfaceable implement, said base plate being completely rotatable about a substantially vertical axis and supported for rotation by bearing means mounted within a deck of a military facility;

b) a hatch displaceably connected to, and located below, an inner face of said base plate, for normally covering a hatchway formed in said base plate when in a closed position and for exposing said hatchway when displaced while protecting a combatant located below said deck or passing through said hatchway; and c) a rotatable disc of a slip ring unit carried by said hatch, by which electricity for operating equipment mounted on top of said deck and for initiating control signals is transmitted to said equipment, said rotatable disc being concentric with said base plate when said hatch is in said closed position, wherein said hatchway is sufficiently large to accommodate passage therethrough to the deck of a combatant usable product in order to access said above deck equipment when said hatch is in a completely displaced position.

2. The turret assembly according to claim 1, further comprising latch means securable to a stationary disc of the slip ring unit to prevent displacement of the hatch.

3. The turret assembly according to claim 1, further comprising a hatch displacement initiator.

4. The turret assembly according to claim 3, wherein the hatch displacement initiator comprises a handle connected to an interior facing end of an axle assembly rotatably mounted within the hatch, for applying a displacement initiating force to the hatch.

5. The turret assembly according to claim 4, wherein the hatch displacement initiator further comprises a locking bar connected to an exterior facing end of the axle assembly and having substantially the same angular disposition as the handle, rotation of the handle in a first rotational direction causing the locking bar to be positioned in abutting relation with an upper surface of the base plate whereby to prevent the hatch from opening, and subsequent rotation of the handle in a second rotational direction opposite to said first rotational direction causing said locking bar to be disengaged from the base plate.

6. The turret assembly according to claim 5, wherein the locking bar is flexible.

7. The turret assembly according to claim 1, wherein the hatch is pivotally connected to the base plate.

8. The turret assembly according to claim 1, wherein the hatch is displaceably connected to the base plate by means of four arm assemblies which allow the hatch to be lowered and displaced laterally from the base plate and then to be returnably displaceable so as to cover the hatchway.

9. The turret assembly according to claim 1, wherein the hatch is displaceably connected to the base plate by means of a rod extending downwardly from the base plate and an engagement member that is attached to the inner face of the hatch and is rotatably mounted about said rod, allowing the hatch to be rotatable about said rod.

10. The turret assembly according to claim 2, wherein the hatch displacement initiator comprises one or more linear actuators connected to an above deck surface fixedly attached to the base plate.

11. The turret assembly according to claim 1, wherein the combatant interfaceable implement is a weapon system.

12. The turret assembly according to claim 10, wherein the one or more linear actuators is selected from the group consisting of a hydraulic actuator, pneumatic actuator, mechanical actuator, and electric actuator.

13. The turret assembly according to claim 1, wherein the slip ring unit comprises an input port unit for connection from an electrical source and an output port unit for connection with the equipment.

14. The turret assembly according to claim 2, wherein the latch means comprises a retractable element that is sufficiently spaced from a corresponding side edge of the hatch when retracted to enable unobstructed displaceable motion of the hatch.

15. The turret assembly according to claim 1, wherein the combatant usable product is an ammunition box.

16. The turret assembly according to claim 1, further comprising control means for preventing the base plate from rotating when the hatch is opened.

17. The turret assembly according to claim 16, wherein the control means comprises a sensor for detecting an openable state of the hatch, and a controller for receiving signals from said sensor and for commanding a turret motor adapted to rotationally drive the base plate to become deactivated when receiving a signal from said sensor that the hatch has been set to an openable state.

18. The turret assembly according to claim 17, wherein the hatch is set to an openable state when it is in a displaced position or when a handle rotatably mounted within the hatch for applying a displacement initiating force has been rotated.

19. The turret assembly according to claim 1, wherein the military facility is an armored vehicle or a defense post.

20. The turret assembly according to claim 19, wherein the armored vehicle is selected from the group consisting of a tank, a retriever, a light armored vehicle, a mobile missile launcher, an armored personnel carrier, and a waterborne combat vehicle.

* * * * *